United States Patent [19]

Axelsson et al.

[11] Patent Number: 4,837,107

[45] Date of Patent: Jun. 6, 1989

[54] TONER FOR ELECTROPHOTOGRAPHIC METHODS AND PROCESS FOR PREPARING THE SAME

[75] Inventors: Anders R. Axelsson, Sundsvall; Lolo Bylander, Njurunda; Sten Porrvik; Olof Tanner, both of Sundsvall, all of Sweden

[73] Assignee: Casco Nobel AB, Stockholm, Sweden

[21] Appl. No.: 173,631

[22] Filed: Mar. 25, 1988

Related U.S. Application Data

[63] Continuation of Ser. No. 928,544, Nov. 10, 1986, abandoned, which is a continuation of Ser. No. 447,124, Dec. 6, 1982, abandoned.

[30] Foreign Application Priority Data

Dec. 10, 1981 [SE] Sweden ..... 8107421
Mar. 18, 1982 [SE] Sweden ..... 8201739

[51] Int. Cl.[4] ..... G03G 9/08
[52] U.S. Cl. ..... 430/138; 430/111
[58] Field of Search ..... 430/138, 111, 107; 428/403, 402.21

[56] References Cited

U.S. PATENT DOCUMENTS

| | | | |
|---|---|---|---|
| 3,893,932 | 7/1975 | Azar | 252/62.1 |
| 4,254,201 | 3/1981 | Sawai et al. | 430/138 |
| 4,336,173 | 6/1982 | Ugelstad | 523/205 |
| 4,459,378 | 7/1984 | Ugelstad | 523/205 |

FOREIGN PATENT DOCUMENTS

| | | | |
|---|---|---|---|
| 2026506 | 6/1978 | United Kingdom | 430/110 |

*Primary Examiner*—John L. Goodrow
*Attorney, Agent, or Firm*—Fred Philpitt

[57] ABSTRACT

A toner and a method for the preparation of toner particles essentially consisting of monodisperse spherical thermoplastic particles having a coefficient of variation below 30 per cent and a mean diameter between 2 and 50 μm, the particles having a shell of polymeric material in which a colorant is distributed. The particles are prepared by treating monodispersed spherical polymerized base particles with a shell-polymer and a colorant and contacted to give a uniform distribution of the additives on the base particles whereafter the shell-polymer is fused to the base particles.

12 Claims, No Drawings

TONER FOR ELECTROPHOTOGRAPHIC METHODS AND PROCESS FOR PREPARING THE SAME

This is a continuation of application Ser. No. 928,544, filed Nov. 10, 1986, now abandoned which is a continuation of Ser. No. 447,124 filed Dec. 6, 1982, now abandoned.

TECHNICAL FIELD

The present invention relates to a toner for electrophotographic processes, which toner comprises spherical thermoplastic particles having a narrow paticle size distribution. The invention also relates to a process for preparing the toner particles.

BACKGROUND OF THE INVENTION

Particles for use as toners in electrophotographic processes must fulfil several requirements in order to function in the intended manner. The particles must be suffieiently hard or they will break down by abrasion during the treatment in the apparatus and also to prevent caking at ordinary operation conditions. On the other hand, the particles must have a sufficiently low melting point to be fixed to the support by conventional methods such as rolling or application of heat. The particles must have suitable magnetic or electrical properties, and particularly the surface must be capable of accepting and retaining the required charge and, especially in cases when the charge is obtained by rubbing against other materials, it must have stable triboelectrical properties. The surface must, however, not be hygroscopic so that water is retained as this can lead to caking of the particles or to a change in the electrical properties. The material of the particles must be resistant to aging and it must be possible to incorporate an aging resistant colorant. The particles should also have as uniform and spherical form as possible to increase the abrasion resistance, to prevent the particles from being fixed to non-desired spots on the charged surface and to make a higher charge, and a charge which is more uniformly distributed between the particles, possible. The particles should also have as uniform size distribution as possible since variations in the size leads to variations in the capability of accepting the charge and thus to a non-uniform deposition on the accepting surface so that the resolution becomes limited.

Known toner materials have only fulfilled the above mentioned requirements to a limited extent. The usual method of preparation, incorporation of a colorant, charge-modifying agents etc. in a plastic mass followed by grinding and screening of the product, certainly makes it possible to choose the material and the additives fairly freely but the obtained particles are of very varying shapes and have a very non-uniform size distribution and this leads to poor abrasion resistance, poor resolution and difficulties in removing the particles, particularly the smaller ones, from non-desired spots on the surface. Alternative methods for preparing toner particles have been suggested and these methods have given particles of a more rounded form, but these known methods have not given the desired narrow size distribution, they have decreased the freedom of choice as concerns the material and the incorporation of additives has been made more difficult.

The preparation of spherical polymer particles having an extremely uniform size distribution by a swelling process to sizes suitable for toner particles is previously known. This method is described in the European patent application 3 905, which is incorporated by reference herein. However, the conditions at the swelling are sure that conventional methods for coloring and adaption of the properties in other respect to the toner-use cannot be used or carried out quite easily.

THE INVENTION GENERALLY

It is an object of the present invention to provide a toner which fulfils the above mentioned requriements better than those hitherto known and which overcomes the deficiencies of those. It is also an object of the invention to provide a process for the preparation of such toner. It is a particular object of the invention to provide a toner which satisfies the requirements but has considerably improved properties as concerns roundness and monodisperse particle distribution. It is another object of this invention to make it possible to use particles obtained according to the process described in the above mentioned patent application as toner material.

The above objects are accomplished by the features evident from the appended claims.

At the production of toner particles very spherical particles having an exceptionally narrow size distribution are obtained by starting from very monodisperse, i.e. small polymer particles of uniform size obtained by emulsion polymerisation and then swelling these to sizes suitable for toner application as described more in detail below. By adding a colorant to the particles after swelling and polymerisation, the particles can be coloured without any negative influence of the addition on the swelling- and polymerisation steps. Further, in this manner a concentration of the additive to the surface of the particles is obtained and this means that a fairly large amount of substance can be added on a small radius increase of the particles so that the uniformity and spherical shape of these can be retained, and it also means that a distribution which is favourable with respect to ligth absorption is obtained, which further diminishes the required amount of additive so that the influence on the shape and size distribution of the particles can be reduced to a minimum. By including the colorant in a shell or by applying a shell as a cover layer on top of the layer of coloured substance there is obtained a possibility to influence several properties which are important with respect to the toner-use without giving rise to a negative influence on the swelling- and polymerisation steps at the production of the particles. By selection of shell material or by additives to this the surface properties of the particles can be modified for example with respect to hydrophilic properties, charge properties, conductivity and melting capability or tack. The shell also functions as a protection against abrasion of the colorant. Also for the shell, and optional additives in this, a thin layer is sufficient for incorportion of considerable amounts of modifying agents. Color- and cover layers on the surface of the particles also give great possibilities of adapting the same monodisperse orginial particles to different toner applications which is of special advantage since substantial changes in the production process for the original particles entail considerable costs.

Other objects and advantages of the invention will be evident from the detailed description below.

DEFINITION OF COEFFICIENT OF VARIATION

The monodisperse order of the particles is in this disclosure expressed by the coefficient of variation (C V). To obtain C V the standard deviation (s) of the sample must first be calculated.

$$s = \sqrt{\frac{1}{n-1} \sum_{1}^{n} (x_j - \bar{x})^2}$$

This means that s is the square root of the arithmetic mean of the squares of deviations of the various items from the arithmetic means of all items. If the diameters of the particles are measured in micrometer, the dimension of S will also be micrometer.

$$C\ V = 100 \times (s)/\bar{x}\%$$

If the diameters of the particles vary according to standardized normal distribution 68 percent of all the particles will have diameters between ±1 C V of the mean.

PREPARATION OF THE BASE PARTICLES

The invention is not limited to a particular method for the preparation of the base particles but any method which gives polymer particles of a suitable monodisperse order and of suitable spherical shape can be used. However, methods based on swelling of smaller polymer particles, and especially such methods wherein the swelling starts from particles having a narrow size distribution, have been found suitable.

A particularly suitable method for the preparation of monidisperse spherical thermoplastic base particles comprises the preparation of an aqueous dispersion of monodisperse seed particles having a mean diameter below about 3 μm, which in addition to the polymer contains a fairly lowmolecular substance with low water solubility but which can be adsorbed in the polymer, addition of a monomer, which is more soluble in water than the low solubility substance but which is capable of being adsorbed by the seed particles containing the low solubility substance, under such conditions which permit molecular migration of the monomer to the particles and absorption therein, and polymerisation of the monomer particles. The thus obtained particles are suitable as base particles for the toner of the present invention.

Incorporation of the rather lowmolecular substance which has low solubility in water can be done by having the substance present at the preparation of the polymer of the seed particles. An improved size distribution is then obtained if the difficultly soluble substance is an oligomer which is formed in connection with the polymerisation of the polymer of the seed particles by selection of suitable conditions in a known manner. The amount of oligomer to polymer in the particles should then be greater than 0.5:1. Another, and preferred, manner for incorporation of the low solubility substance is to add this to the aqueous dispersion of the seed particles under such conditions that the difficultly soluble substance can migrate molecularly to the particles and be absorbed in them and swell and that the conditions in the aqueous phase are then changed so that the molecular migration of the difficultly soluble substance is made more difficult before the addition of monomer.

The preparation method described above requires addition of small monodisperse particles as a kind of seed material for the subsequent process. Highly monodisperse polymer particles can for example be prepared by emulsion polymerisation under certain conditions, but only in sizes below about 3 μm. Seed particles in the size range from 0.01 to 1 μm, and particularly from 0.05 to 0.5 μm, are suitable for the invention. The coefficient of variation should be below 30 percent, better is below 20 percent, preferably below 10 percent and most preferably below 5 percent. The polymer material of the seed particles is not particularly critical relative to the present use since the polymer part originating from the seed polymer will be very small in the finished particle. The polymer should, however, be insoluble in water. Suitable polymers are for example polyvinyl chloride, polyvinyl acetate, polybutyl acrylate and particularly polystyrene. A method for the preparation of monodisperse particles which are suitable as starting material is for example disclosed in the journal article Woods, M. E., Dodge, J. S. and Krieger, I. M., J. Paint Techn. 40, 541 (1968), which is incorporated by reference herein.

The monodisperse particles should preferably be dispersed in water in connection with the swelling. A suitable dry content for such a dispersion can be about 10 to 15 percent by weight.

As has been mentioned a substance which is difficultly soluble in water shall be incorporated in the seed polymer. The water solubility of the substance should be greater than that of the seed polymer, but should be below $10^{-2}$, preferably below $10^{-4}$ and most preferably below $10^{-d}$ g/1. The molecular weight should be below 5000 and preferably also below 500. The substance is preferably organic to obtain the most satisfactory compatibility with other components and it should be nonionic with respect to solubility. Hydrocarbons and substituted hydrocarbons can be used. Examples of such substances are chlorododecan, dioctyladipate, stearylmethacrylate or a difficultly soluble initiator such as dioctanolyperoxide. It is also possible to use an oligomer as the difficultly soluble substance, particularly when the substance shall be incorporated in the seed particle directly in connection with its preparation, according to what has been said above. The substance should be liquid at the conditions at the swelling and monomer addition.

When the difficultly soluble substance shall be incorporated in the seed particle by molecular migration through the aqueous phase to the seed polymer, measures must be taken to facilitate this migration, due to the difficultly soluble character of the substance. This can be done by dividing the substance finely toghether with an emulsifier to increase the contact surface to the water, or by adding a solvent such as lower alkanols or aceton, to increase the solubility in the so treated aqueous phase. The methods can advantageously be combined. The upper amount of added and absorbed difficultly soluble substance is limited by the capability of the substance to be absorbed in the seed polymer and by the stability of the swelled particle. The amount is normally kept at less than 10 times the weight of the seed polymer, and preferably between 1 and 4 times the weight of this. The swelling is carried out under agication.

When the monomer is added to the dispesion of polymer particles or polymer/oligomer particles or particles of polymer with absorbed low solubility substance, the conditions in the aqueous phase should be such that migration back of the difficultly soluble substance, from the particles into the aqueous phase and to the monomer drops, shall not occur. When a solvent has been used for incorportion of the difficultly soluble substance the conditions are suitable changed before the monomer addition by evaporation of the solvent and/or by dilution of the aqueous phase. The difficultly soluble substance should be as completely absorbed in the seed particles as possible before the monomer is added.

The later added monomer should be more soluble in water than the difficultly soluble substance, preferably at least 10 times as soluble and most preferably at least 100 times as soluble in water. Several different kinds of monomer can be used for the purpose of the invention and among suitable monomers which are polymerisable in water can be mentioned styrene, vinyl chloride, vinylidene chloride, acrylonitrile and acrylates, such as methyl acrylate, ethyl acrylate and methacrylates such as butylmethacrylate. Mixtures of different monomers can also be used. Particularly suitable monomers are styrene, styrene-acryl, styrene-acrylo nitrile-acryl or vinylidene chloride-acrylo, nitrile. The monomer is selected among other things with respect to desired softening properties. When the toner particles are to be used in processes wherein they are fixed by application of heat it is desired that at least part of the polymer content of the finished particle has a glass temperature below 100 ° C., preferably below 80° C. Most preferably the glass temperature is above 30° C. Suitable hardness properties can also be influenced by the degree of polymerisation. The amount of added monomer is greater than the amount of difficultly soluble substance in the particles and can be up to more than 1000 times the weight of the swelled particles, preferably up to 800 times this and particularly between 20 and 300 times the weight of the particles before the monomer addition. It is desired that the added monomer mixture is absorbed in the particles as completely as possible before the polymerisation to avoid formation of new polymer particles in the aqueous phase as this seriously impairs the desired uniform particle size distribution. Also the swelling with the monomer is carried out under agitation. It is preferred that the entire amount of monomer is added directly but when the amounts are large it is possible to add the monomer batchwise.

After the monomer addition the polymerisation can be carried out. Initiators, paticularly such which are difficultly soluble in water, can suitably be introduced as the difficultly soluble substance or together with such a substance before the monomer addition but it can also be added in connection with the addition of monomer, or after this. Preferably a monomersoluble intiator with low water solubility is used, such as the mentioned dioctanyl peroxide, to avoid polymerisation in the aqueous phase.

After the polymerisation more of the difficultly soluble substance and/or monomer can be added and new polymerisation carried out to further increase the size. Optionally only monomer is added to get a limited further swelling. The number of swelling steps is arbitrary but preferably the desired size increase is achieved by as few steps as possible, which gives the most advantageous properties of the product. Normally only one or two steps are thus used.

A suitable size of toner particles according to the invention is between 2 and 50 μm, preferably between 5 and 25 μm and most preferably between 8 and 15 μm. The base particles should thus be swelled to a size such that they after the shell application described below get a size within these limits.

The enlarged particles described above have a size distribution which almost corresponds to that of the originally used seed polymer. They are thus monodisperse and have the same preferred values for the coefficient of variation which have been given above for the seed polymer. This is dependent on the fact that the swelling steps are carried out in a balanced and for all the particles uniform manner and on the fact that the absorption of the added substances to a high degree is determined by equilibrium conditions and not only by diffusion rates. The liquid character of the added substances also lead to a very spherical shape of the particles. These properties are very valuable for toner applications, but to obtain a toner for use in practice certain additions must be made and the most important of these is the addition of a colorant. However, as mentioned by way of introduction, it is difficult to incorporate additives before the polymerisation without interfering with these processes and without spoiling the uniform size distribution. If the additives are divided into such which are molecularly soluble in the particle material and such which are not molecularly soluble but form a phase of their own, usually a solid phase, if they are incorporated in the particles, both groups will give problems if attempts are made to incorporate the materials at an early stage in the production process. The soluble substances are as a rule organic dye stuffs, contining reactive functional groups which tend to react with the initiator and make the polmerisation more difficult, change the formed polymer and be changed themselves in a non-desired manner. Solid additives, which are not soluble in the particle, cannot easily be incorporated in the inner of the particle before the polymerisation in a controlled manner as the absorption capacity of the particle is not controlled by conditions of solubility or of equilibrium and thus a non-uniform absorption will easily occur leading to a broadening of the size distribution. It is also difficult to select a colloid- or emulsifier system which will both efficiently stabilize the swelled particles against coalescence and at the same time permit passage of the pigment particles through the phase boundary surface.

On account of the above reasons it has been found suitable to incorporate required additives after the polymerisation reaction. However, after the polymerisation the colorant can hardly be incorported homogenously in the inner of particles without giving at least a concentration at the surface. From reasons accounted for above this is per se advantageous. However, if this is the case the requirements on a good adhesion to the particles are great as color material which has come loose from the particles spoils the size distribution of the toner and gives rise to problems with miscoloration of the finished copies. These problems increase with the amount of color material to be incorporated and it is consequently difficult to provide the particles with a sufficient amount of colorant and at the same time achieve a satisfactory adhesion of this to the polymerised particle as this is solid and little penetrable to additives of different kinds. Still other problems to solve when the additions are made after the polymerisation of the particles are that the final surface must show all the properties required for the toner application, which were mentioned in the introduction, such as suitable electrical properties, reasonable hydrophilic properties and suitable softness and other mechanical properties. The colorant itself is seldom advantageous in these respects. The conductivity is often too high and the charge properties too poor, and at the same time the adhesive properties are unsuitable. Finally, it must be possible to carry out the incorporation in such a manner that the spherical and monodisperse character of the particles is not lost since otherwise the desired properties will not be obtained. A particular problem in connection with this is that there is a risk of agglomeration of the particles at the incorporation.

PREPARATION OF A SHELL

A. General remarks

According to the invention an addition of a coloured substance after the polymerisation of the base particles is made possible and in such a manner that the above mentioned requirements on the conditions of the surface can be satisfied. This is achieved by coating the surface of the base particles with a shell of a polymer comprising or covering a coloured substance. By means of the polymer shell a satisfactory adhesion can be secured as the requiements for adhesion between the base particles and the added colorant are reduced. As the shell in principle can be made to have any thickness, or at least to be considerably thicker than for example a layer of pigment, a sufficient amount of colorant can be incorporated in the particles in this manner. The polymer material of the shell can be selected to fulfil the required conditions of the surface. As mentioned in the introduction the shell structure also gives a suitable distribution of the colorant with respect to light absorption and a suitable possibility of varying the properties of the base particles.

The above mentioned requirements should be considered when the polymer material for the shell is selected and this should also be selected with respect to suitable softness of the material and with respect to the fast that the colored substance that is used should be wetted by the polymer. A liquid colorant should be at least partly soluble in the polymer and a pigment should be capable of being dispersed in the polymer. For some of the methods below it is suitable to select a polymer which is soluble in a solvent or stably dispersible in a dispersion agent. Suitable monomer for the polymer material of the shell are the same monomers previously mentioned for the base particles. However, different materials can be used for the core and the shell respectively. In practice the materials of the core and the shell will be somewhat different in most cases as the preparation process for the base particles demands the presence of certain substances which are specific for this process such as the difficultly soluble swelling agent. Strongly hydrophilic polymers should not be used for the shell and neither should emulsifiers be present in any considerable amounts since these might make the surface of the finished particle hydrophilic. Alternatively, residues of emulsifiers can be washed away after the coating. Copolymers of styrene and butyl methacrylate have been found to be particularly suitable. Additives for different purposes can be present in the polymer, as has been mentioned, for example charge regulating additives. The material of the shell can advantageously be different from that of the core as concerns mechanical properties. When the toner particles are to be used in connections wherein they are crushed by mechanical pressure and fixed to the paper the core can be of an adhering material to get the best adhesion while the shell can be harder to avoid agglomeration of the particles before the fixation. When the fixation instad shall be carried out by heating the core can be harder than the shell and the fusion at the fixation will then essentially take place between the outer parts of the particles while the harder core contributes to a matt picture and a generally more durable particle. Although thermoplastics are preferred it is also possible to use curable plastics such as condensation products between formaldehyde and urea, melamine, phenol or resorcinol or other curable systems based on amines, acid chlorides or isocyanates/polyols. After the application a curing process must then be carried out. Shell of curable plastics can be of particular value for particles of the kind which, according to the above, are crushed and fixed by pressure.

The amount of polymer in the shell should be so great that the desired amount of colorant can be stably covered or included in the shell. However, the amount shluld not be so great that the incorporation thereof detrimentally influences the intended size distribution of the particle mixture. In those cases where the colorant is distributed in the shell the volume ratio between shell and core is suitably kept between 0.1 and 10, corresponding to an increase of the radius of the core of between about 3.2 and 122 percent, but the volume ratio is preferably kept between 0.2 and 1 (6.3 to 26 percent increase of the radius) or 0.5 to 5 to keep pigment concentration low to limit conductivity. In those cases where the colorant shall only be covered by means of the shell the volume ratio can be lowered down to 0.01 but the ratio is preferably kept above 0.05.

The colorant can be a molecularly soluble substance e.g. an organic dye but it is preferred to use pigments, particularly inorganic pigments, to get the most satisfactory long term durability, and then particularly carbon black or magnetite in those cases wherein magnetic particles are of importance. For pigments the volume amount based on the volume of the entire particle should be between 0.5 and 50 percent, paticularly between 1 and 25 percent. When the colorant is incorporated essentially in the shell the amount based on the volume of the shell should be between 2 and 60 percent and preferably between 5 and 40 percent. For soluble organic dyes the amount is more easily calculated on basis of the weight and in these cases the above given numerical values can be used as percent by weight values instead. Used pigments should have a particle size which is clearly below that of the base particles, e.g. below 3 μm and especially below 1 μm. Very small particles may give rise to an increased tendency to agglomeration and it is thus preferred that the size is above 0.01 μm and preferably also above 0.1 μm.

It is of course possible to arrange shell structures on the base particles. It can for example be suitable to have an inner shell with a colorant and an outer shell without colorant, to protect the colorant against abrasion as much as possible. In these cases it is of course only necessary to adapt the surface properties of the outer shell in the manner discussed above and the material of the inner shell can be selected more freely.

According to the invention the base particles are provided with a colorant and a shell, as described above, by adding to them after the polymerisation, the colorant and a powder polymer, a solution of the polymer in a solvent or a dispersion of the polymer in a dispersion medium and by being contacted with these components until an even distribution of the components on the surfaces of the base particles is obtained and the solvent is evaporated or the polymer is fused by heat. The expression "polymer solution" includes also partly dissolved or partly dispersed polymers, such as a polymer which has been partly precipitated from a solution. It is, however, preferred that pure solutions are used at the preparation of a shell using solvent according to the invention.

The colorant can be added to the base particles before the polymer powder, solution or dispersion is added, e.g. by making a liquid colorant wet or penetrate the base particles, optionally in the presence of a solvent as a means for aiding diffusion. Alternatively, a solid colored substance such as a pigment can be distributed on the base particle surface e.g. by being treated mechanically together with the base particles. A solvent or dispersion agent can optionally be used also in this case to facilitate the adhesion of the pigment particles to the base particles and/or to soften the surface of the base particles to improve the retention of the particles. Methanol has successfully been used as solvent in this case. Any solvent is evaporated thereafter and the polymer solution or dispersion is then charged for formation of the shell. This method gives the best protection of the added colorant.

It is, however, preferred that the colorant is mixed with the polymer powder, solution or dispersion and added to the surface of the base particles together with this. This is a simple method which also as a rule gives the best distribution of the colorant and the best adhesion between base particle, colorant and shell. It also has the least influence on the size distribution. In a polymer solution the colorant can be either dissolved or slurried. In a polymer dispersion the colorant can be present outside the polymer particles in the dispesion medium but for the best adhesion it is preferred that the dye or pigment is in the polymer particles. In a polymer powder the colorant can be present in the polymer particles or be present between the particles as a separate phase. In the later case the colorant must be well mixed with and distributed in the polymer particle mass. A pigment should thus preferably be distributed on the surface of the polymer particles which can be achieved by intimately mixing the components and grinding them together.

The polymer for the shell can, as has been mentioned, be added in a solvent. Hereby an low viscosity fluid component is obtained, which, when charged to the base particles, can be distributed in a layer surrounding these with maintained sphericality of the particles. By selection of the solvent the viscosity and thus the amount of polymer deposited on each particle can be controlled within certain limits. The viscosity, in combination with the surface tension of the solvent, contributes to a levelling of the variations in applied amount on different particles which is of importance in cases where the size distribution must not be considerably increased at the shell formation. The behaviour of the colorant in the solution can also be influenced to some extent by the selection of the solvent.

The solvent selection is thus decided from the following: the polymer shall be soluble in the solvent to the required extent, the colorant shall be soluble or stably dispersible in this, it shall be possible to incorporate optional other additives, no residues which are unsuitable for the toner application shall remain after the evaporation of the solvent and the kind of solvent is also decided from the influence of the solvent on the base particles. It must also be easy to evaporate the solvent and the solvent should not be absorbed by the base particles in a too high extent. Solvents which have been tested and found suitable includes hydrocarbons, such as cyclohexane, and chlorinated hydrocarbons such as methylene chloride. Methanol, acetone, methyl acetate and ethyl acetate have also been found suitable.

The amount of polymer in the solvent should be kept fairly low as this contributes to a good distribution of the composition. The amount must however be kept high enough to give the desired thickness of the shell. Suitable amounts of polymer in the solvent are between 1 and 30 percent by weight and preferably between 5 and 20 percent by weight. When the colorant is to be added with the polymer solution the amounts can be lowered somewhat further. It is however essential that the colorant can be stably included in the solution. For pigments it must be possible to form a stable dispersion and maintain it when the solvent is evaporated as otherwise the pigment will not be uniformly distributed and the adhesion will be at risk. Stabilizers can be used but their influence on the properties of the final surface must be considered. It is suitable to adjust the hydrophility of the pigment and of the solvent or dispersion agent to each other and to choose for example an oxidized carbon powder for a polar agent and a non-oxidised, hydrophobic carbon for non-polar agents. As a rule it is suitable to grind, or divide the pigment finely in another manner, in the already prepared solution of the polymer containing optional other additives. The amount of colorant is adjusted with respect to the amount of polymer in the solution in such a manner that the above given amounts of colorants are obtained after evaporation of the solvent.

The polymer can also be added in the form of a dispersion of small polymer particles in a dispersion medium. This is preferred when it is desirable to avoid solvents for example to lower the risk of agglomeration when a tacky stage must be passed at the evaporation of the solvent or to avoid negative influence of the solvent on other components in the system. In most cases it is also more easy to evaporate a dispersion medium than a solvent and the risk of having the polymer particles contaminated with un-desired components is smaller with a dispersion medium than with a solvent. The dispersion can be prepared by dividing a colored substance such as carbon powder in a monomer and adding polymerisation aids such as a monomer soluble initiator. The mixture can then be finely divided in water in the presence of a mild emulsifier such as ammonium laurate to as small droplets as possible, e.g. between 0.5 and 1 μm, and the polymerisation of the monomerdrops in the aqueous phase is then triggered. In this manner polymer particles containing well-included colorant can be obtained. Smaller polymer particles in the dispersion can be obtained by conventional emulsion polymerisation in the aqueous phase using water soluble initiator. Although this method can give particle sizes down to about 0.1 μm it is difficult to incorporate a colorant in the particles and a colorant is then suitably added to the dispersion medium in the form of a separate dispersion. At the preparation of a shell the polymer particles and the colorant will then be charged to the base particles at the same time and due to the finely divided nature of the added components they can be made to fuse in to a well-sintered shell for example by heating. It is easy to change the ratio between polymer and additive with this method.

The selection of a dispersion medium is less critical than the selection of a solvent for a polymer solution. Water is normally used. The polymer content in the dispersion is also less critical than the polymer content in a polymer solution but can suitably be kept at between about 5 and 40 percent by weight.

The polymer can also be added in dry powder form to the base particles. The addition of the polymer and a colorant is made under agitation and at a temperature which is sufficiently high for allowing adhesion of essentially the entire amount of added shell-polymer to the surface of the base particles and at a temperature which is sufficiently low for preventing any substantial mutual agglomeration between the base particles, both the uncovered and the covered.

If the shell-polymer is applied directly in powder form and at a temperature which allows direct adhesion of the powder on the base particles a simple process technique can be used as it is not necessary to use any solvents or dispersion media. Further, the added powder accumulates very satisfactorily on the surface of the base particles, without leaving free or non-bonded powder in the mixture. If there are any free impurities in powder form they are more easily collected than in a system based on solvents or dispersion media. The agglomeration tendency is low as the sintering of the small powder particles takes place at lower temperatures and thus at a lower adhesion than required for fusing the larger base particles together. It is not necessary to pass a very tacky stage. Also lightly agglomerated shell-polymer will be decomposed and will adhere satisfactorily to the base particles.

The method of adding the polymer powder, solution or dispersion and of fusing the polymer to the base particles by heating or by evaporating the solvent or dispersion medium respectively are very important for the final properties of the particles. If the particles are allowed to agglomerate during these stages of the production the final spherical form of the particles will be impaired and the monodisperse distribution will be ruined. Even if agglomeration does not occur, the size distribution can be impaired if varying amounts of polymer are adsorbed on the different particles and it is thus desirable to control this adsorption to a certain extent.

Generally, suitable processes for the preparation of a shell should thus include a step in which the polymer is added to the surface of the base particles in a as well-defined and uniformly thick layer as possible and a further step in which heat is added or the solvent or dispersion medium is removed under such conditions that agglomeration of the particles can be avoided to the greatest possible extent. The ways of carrying out these steps will necessarily vary somewhat depending on whether the particles are kept apart from each other by means of a gas phase or a liquid phase.

B. Gas phase separation techniques

Using a gas phase for separation of the particles usually gives a good control of the growth of the shell thickness and makes it possible to have a simple design of the production process equipment apparatus. When dispersing the particles in a gas known distributing methods can be used. It is particularly suitable to fluidise the particles with a gas stream. Although an ideal separation without any contact between the particles is desirable in principle, this condition is not necessary in practice. The minimum requirement is, however, that the particles are kept in continuous movement with respect to each other, and this can most simply be attained by a vigorous agitation of a particle bed. The purpose of the separation is to prevent the particles from agglomerating during fusion by heating or the removal of the solvent or dispersion medium and to prevent them from having such an influence on each other that the spherical form is impaired or the narrow particle size distribution is broadened.

A preferred manner of carrying out the process comprises several steps. Microscopically, the base particles shall first be contacted with the powder or wetted by tha added solution or dispersion then the added components shall be uniformly distributed between the base particles in a smoothening step and finally the additives shall be adhered to the base particles in a fusing step. A preferred manner for the contact step compirses spraying the solution or dispersion in the form of fine drops on a bed of the particles or slowly adding the polymer powder on a bed of the particles.

A smoothening operation is for solutions or dispersions then most simply carried out by selecting consistency or surface tension of the solution or dispersion so that an essentially uniform amount of the solution will be left on the surface of each particle when these are separated from each other after careful wetting and mixing. Repeated contacts or collisions of the particles are however desired in order to get a good distribution.

The evaporation operation can partly be carried out at the same time as the other operations. The risk of agglomeration is at its greatest during the last part of the evaporation and at least this last part must thus be carried out after or during the separation described above. During this phase it can thus be suitable to increase the distance between the particles and/or decrease the relative movement between these and the gas by adding more gas or increasing the gas velocity. Heating can be applied in order to facilitate the evaporation. When a bed is vigorously agitated according to what has been said above the agitation work is often sufficient for heating. Inert gas can also be blown through to facilitate the evaporation and this is particularly suitable when it is primarily desired to increase the separation of the particles. Vacuum can also be applied and this is preferred when it is desired to avoid particle losses in the leaving inert gas or when it is desired to increase the friction in a bed under agitation, e.g. to heat the bed.

For the final fusion and smoothening of the surface of the shell particles can be heated rapidly for melting of the surface and the particles shall then be well dispersed and separted in the gas phase.

It is not necessary to carry out the above described operations in the form of steps which are separate from each other or in separate apparatuses but it is possible to carry out the steps at essentially the same time and in the same apparatus space. It is for example possible to carry out wetting smoothening and evaporation in an agitated bed with separation of the particles and also with collisions of these. It has been found particularly suitable to charge the base particles to a fluidised bed and spray the solution or the dispersion into this in the form of fairly small droplets, for example of about 50 μm, and the wetting and smoothening will then take place essentially at the same time while the particles are in a fluidised condition and separated from each other. The evaporation of the solvent or dispersion medium is carried out at the same time by application of heat, vigorous gas passage or application of vacuum. A shell formation on the microscopic level will in this manner take place in several steps by repeated wetting, smoothening and evaporation.

When the shell-polymer is added in dry powder form the contact step follows by making the addition directly to a bed of base particles and smoothening and distribution over the surface of these is obtained by means of the repeated contacts resulting from the agitation of the bed. To secure adhesion of the powder to the base particles and to avoid free powder in the finished product the powder should be charged continuously and not faster than it is adsorbed on surfaces of the base particles. The most important control parameter for the adhesion and the shell foramtion is hereby the temperature.

The temperature should be selected high enough to obtain a sufficient adhesion between the powder particles and the base particles so that the small powder particles are retained on the base particle surface. However, the temperature must not be so high that there is a mutual agglomeration between the base particles or between the powder particles. The temperature must thus not be so high that the base particles lose their structure during this stage and neither should the shell powder be melted. It is thus desirable that the properties of the base particles and the shell polymer are selected with respect to each other in such a manner that there is no essential adhesion between them at low temperature and that at an increase of the temperature there will be a phase wherein the adhesion is sufficient for the shell-polymer particles to adhere satisfactorily to these particles but where the adhesion is not sufficient for keeping the base particles mutually together in the bed and that a further increase of the temperature leads to a phase where the shell polymer becomes sintered, whereby the risk of agglomeration usually increases. To obtain this behaviour the softening temperatures of the polymer of the base particle and that of the shell powder can be adjusted with respect to each other, for example in such a manner that they soften at somewhat different temperatures. Another way of influencing the behaviour is to add a tackifier, for example dioctyl adipate. The suitable temperature range for the shell formation will, however, be rather narrow and must be tested for each individual system. For shell polymers having a definite glass temperature it has for example been found suitable to carry out the shell preparation between about 0 and 10 centigrades below the glass temperature while sintering is obtained at between about 5 to 20 centigrades above the glass temperature.

After the shell formation the temperature should be increased to the above discussed sintering temperatures for a short time to sinter the shell polymer and to improve the spherity of the final particles. During this operation no additional shell-polymer should be charged. The temperature is however very crucial. If the temperature is allowed to go too high an uncontrolled caking of the particles in the bed will occur. The sintering can be carried out in the same agitated bed as for the shell formation but the separatiohn of the particles can also advantageously be increased during this operation. Known distribution methods can be used and it is particularly suitable to fluidise the particles by means of a gas stream.

The above descrived operation for the shell preparation can, if desired, be repeated one or several times. At it is more easy to obtain a shell tickness which is uniformly distributed between the different particles if the applied amount is small, it is suitable to use a repeated treatment when a thicker shell is to be formed. Also in those cases when it is desired to have an outer shell with other properties than an inner shell according to what has been said above, the operation manner can be repeated.

When the formation of a shell takes place under conditions which allow contact between the particles a certain agglomeration cannot be entirely avoided. The smaller the particles are, the bigger are the problems. However, if any bridges have been formed these can if desired, be broken by careful ginding e.g. in a pin mill or by temporarily increasing the agitation of the bed.

One way of avoidning agglomeration and increasing the free-flowing properties which can be used during the entire production process and which is particularly suitable for small particle sizes below about 10 μm comprises mixing the base particles with considerably larger, preferably spherical, particles of e.g. a polymer material as auxiliary material during the process and these particles can later be separated. To increase the free-flowing properties of the powder mass these auxiliary particles should be considerably larger than the base particles, suitably between 10 and 100 times as large or for example from about 0.5 to 2 mm. Better free-flowing properties are obtained with a larger amount of auxiliary patticles but at the same time the production capacity decreases and it is thus suitable to have a content of auxiliary particles between about 20 and 90 percent by weight in the powder mass. As the auxiliary particles are present at the coating operation these will also be coated by a layer of the added polymer. The layer on the auxillary particles will however not be thicker than that on the base particles and since the size difference is pronounced the surface of the auxiliary particles does not represent more than a fraction of the total surface of the powder mixture and the polymer loss will thus be negligible. Also the radius increase of the auxiliary particles, calculated as percent, will be minor and the auxiliary particles can consequently be re-used several hundred times without any unacceptable size increase. After the coating process the auxiliary particles can be removed and this can be done with simple method, for example by screening, since there is a considerable difference in size between these and the toner particles.

Another way of avoidning agglomeration is to add a powder of a substance which is not sticky at the conditions used. In fact, a colorant in the form of a pigment can act as a powder stabilizer in the present method. An enhancement of this effect can, however, be obtained by using a larger amount of powder, a powder of smaller particle size than the pigment or a powder less wettable by the polymer than the pigment. Generally the powder is inorganic, like colloidal silica or colloidal aluminium oxide. It is preferred that the added powder can later be removed which is possible if the substance selected can be decomposed and evaporated, e.g. ammonium carbonate, or is soluble, like aluminium or magnesium hydrates. Use of powder stabilizers is of greatest value at the fusion step and the addition can preferably be made in this step. The powder stabilizer is further of greatest value for dry powder polymer or dispersed polymer.

C. Liquid phase separation techniques

Use of a liquid phase for keeping the particles apart at the production of the shell generally gives low risks of agglomeration of the particles, a simple process with respect to production technique and not so great problems with respect to solvents. A preferred manner of carrying our the process comprises mixing the base particles in dispersed form with an emulsion or dispersion of the shell polymer, optionaly containing a colorant as has been said above, precipitating the particles of shell polymer and colorant on the surface of the base particles, sintering the so formed shell and separating the shell-covered base particles from the dispersion.

In this process a polymer solution of the above type can be added in the form of an emulsion to the dispersion of the base particles. After the emulsion drops have been precipitated on the base particles a certain sintering of the shell takes place as a direct consequence of the liquid character of the precipitated particles. The solvent can then be removed in any known manner, for example by being allowed to slowly diffuse through the phase of dispersion medium and this process is facilitated by using a water soluble solvent. The shell polymer can also be added in the form of a dispersion of polymer particles, according to the above, and then either microsuspensions of the polymer with included colorant or a dispersion of emulsion polymerised particles, which does not contain a colorant but with this additive in the dispersion medium, can be used. In this case solvent is not required and consequently neither removal of solvent buth there are higher requirements on the sintering step for the shell. The dispersion medium is suitably based on water in all the cases.

Precipitation or flocking of the shell-polymer particles on the surface of the base particles is suitably carried out by changing the colloidal conditions in the dispersion. If for example, a fatty acid type emulsifier is used for the dispersion of base particles and shell polymer particles flocculation can be accomplished by addition of salts, especially salts of alkaline earth metals, or by lowering the pH by means of adding acid. The change of the conditions should be carried out slowly to obtain a good control of the flocculation process. Alternatively, it is possible to add the shell-polymer dispersion slowly to the base particle dispersion, in which the conditions are already adapted so that the shell-polymer will flocculate when introduced therein. The process shall be interrupted when a sufficient amount of shell-polymer has been precipitated on the base particles but before there is a mutual agglomeration of the base particles.

To facilitate the flocculation of shell-polymer on the base particles, and to improve the adhesion to these, the surface of the base particles can be pretreated with substances which improve the adhesion to the shell-polymer particles. The adhesion agent should have a low water solubility so that it will not diffuse also to the surface of the shell-forming polymer particles. Suitable agents are organic liquids such as dioctyl adipate, or insoluble soaps such as calcium soaps of fatty acids.

A steric stabilizer, for example polyvinyl alcohol, can be added in order to stabilize the flocculated shell or to interrupt the flocculation. This will among others facilitate the sintering step when this is made in water suspension.

After stabilization and sintering the shell covered base particles can be removed from the dispersion. The particles can thereafter optionally be washed to remove emulsifier residues. If desired a further sintering of the shell can be accomplished after the drying by heating in a gas stream to get a maximum strength and sphericity.

PREPARATION OF SHELL POLYMER POWDER

A typical size for base particles used according to the invention is 10 μm. These are then coated with polymer particles to a shell having a typical thickness between 1 to 2 μm. As the shell is very thin the polymer particles for its production must be very finely divided and preferably all the particles should have a size which is less than one tenth of that of the base particles, or less than 1 μm. It is normally not possible to produce such a fine polymer powder by grinding a polymer. If for example a pigment and a suitable polymer for toner are mixed under melting and the cooled polymer is then ground, polymer particles having a size considerably larger than 1 μm will be obtained. It is neither possible to separate all grains above 1 μm from a powder ground in this manner in a practicable way by means of known wind siewing separating processes. For inorganic materials the lower size range for wind siewing separation is around 1 to 5 μm, while it is higher for polymers (ref.: Chemie Technik, 8 Jahrgang (1979) No. 5). Pigments of a sufficiently fine particle size can generally ge obtained without difficulties.

The polymer powder which shall form the shell, especially but not exclusivly in the dry powder methods, can be produced in different manners. However, common to the preferred methods is the preparation of finely dispersed polymer dispersion in water at first. The particles in this polymer dispersion are generally smaller than 1 μm.

The invention thus also relates to a process for the preparation of a shell-polymer in powder form, which process comprises preparation of an aqueous dispersion containing finely dispersed polymer particles and finely dispersed colorant, drying the dispersion at a low temperature and grinding the dried dispersion if required.

It is preferred that the polymer particles in the dispersion are formed from a liquid precursor since this facilitates a disintegration into small sizes. It is particularly suitable to emulsify the monomer in this manner before the polymerisation. The polymerisation can then be carried out as emulsion polymerisation using water soluble initiator or as suspension polymerisation using monomer soluble initiator. The colorant can be present either in the polymer particles of free in the dispersion, and the colorant is preferably a pigment.

Some preparation methods will be described more in detail below.

One method of preparing the polymer powder for the shell formation comprises at first emulsion polymerise monomers, using a water soluble initiator so that a polymer latex having particles which throughout are below 1 μm is obtained. This latex can then be contacted with carbon or magnetite pigment. The mixture is then subjected to shearing stresses in a grinding step so that an intimate mixture of the latex and pigment is obtained. In the next step the latex-pigment mixture is dried at such a low temperature that the primary particles in the latex are only agglomerated, without beeing melted or fused. After drying the mixture is ground to the finest possible particle size using suitable equipment. Owing to the low drying temperature and the intimate mixture between the latex and pigment the product is very easily ground. Also the presence of solid pigment particles between the polymer particles is of primary importance for avoiding agglomeration and for simplifying the grinding step. It also makes it possible to use slightly higher temperatures without agglomeration risks, than would otherwise be possible. After grinding the latex will, however, contain particles having a size considerably above 1 μm. At the conditions in the free bed mixer at the shell formation these particles will however be disintegrated owing to the presence of primary particles with a rather weak bonding between the primary particles. It is hereby possible to prepare a uniformly thick shell with a smooth outer surface. Using emulsion polymerisation it is also possible to obtain latex particles of a very uniform size which also contributes to a uniform shell structure. Emulsion polymerisation can also be used to prepare an uncolored polymer for the optional outermost shell discussed above.

An alternative method of preparing a finely divided powder for the shell formation comprises dispersing pigment in a monomer mixture at first. An initiator is also dissolved in the monomer and the monomer is then emulsified in water, using suitable surface active substances. This emulsion is then finely divided, for example by means of high-pressure homogenisation. The emulsion is then subjected to polymerisation and a finely grained polymer dispersion containing well-included pigment is obtained. The polymer dispersion is then finely ground. The obtained powder is used for formation of shell in a manner similar to that used for the powder prepared as described above.

Still another method for preparing a finely grained powder for shell formation comprises dissolving a polymer, e.g. a styrene-butyl methacrylate copolymerisate in a solvent. The solution is emulsified and then homogenised in the presence of suitable emulsifiers. The solvent is then removed from the finely divided emulsion. The microsuspension obtained in this manner is then mixed with pigment and dried, to be later ground and used as material for formation of a shell on the base particles. The pigment can also be mixed into the solution before the homogenisation. This method makes it easy to incorporate different additives in the shell but the use of a solvent complicates the process technique.

When drying the dispersion described, it is suitable to use freeze-drying technic since at low temperatures the polymer will be harder and will have less tendency to agglomerate. The method is generally usable but is of special value when no pigment is present between the polymer particles to stabilize the powder against agglomeration and fusing.

Although the shell covering methods have been described above in relation to monodisperse particles of thermoplastic materials it is possible to use the methods for covering also for other monodisperse particles of a suitable size, spherical form and size distribution as the methods generally do not impair these properties of the base particles. The base particles can thus for example be of another organic material, such as thermosetting resins, or of inorganic material such as glass or metal.

The described particles can be used as toner particles in a manner known per se in electrographic, magnetographic and especially erlectrophotographic methods. They can be mixed with conventional developing- and carrier particles, for example of steel or glass, or be used as one-component toners. They can be used for wet methods but are particulary suitable for dry methods.

EXAMPLE 1

77 ml water, 11.7 ml of chlorododecan, 1.8 g of benzoylperoxide, 9.3 ml of dichloroethane and 0.2 g of sodium laurylsulfate were homogenised in a two-step Manton Gaulin homogeniser, model 15 M, with 200 kg/cm$^2$ in the first step and 80 kg/cm$^2$ in the last step for about 1 to 1.5 minutes and this resulted in an emulsion with particles having a size in the order of 0.1 to 0.2 μm. A seed latex of monodisperse polystyrene particles having a diameter of 0.65 μm (determined by electron microscopy) was added to the emulsion. The amount of seed latex added was 83.8 ml, containing 77 ml of water and 6.8 ml of styrene particles. Additionally 6 ml of water and 8.5 ml of acetone were added under agitation at 35° to 40° C. After agitation for 12 hours at 40° C. the acetone was removed by evaporation under vacuum. When the acetone and the dichloroethane had been evaporated 1.0 g of sodium laurylsulfate and 840 ml of water were added so that the amount of water was 1000 ml. Further 275 ml of distilled styrene were added under agitation at 30° C. After agitation for 2 hours at 30° C. the temperature was increased to 60° C. and the polymerisation started. After 25 hours polymerisation a monodisperse latex having a particle diameter of 2 μm was obtained.

This latex was used as a starting material for a second swelling and polymerisation step. 28.5 ml of the latex, containing 25 ml of water and 3.5 ml of polystyrene particles, were mixed with an emulsion of 35 ml of water, 4 ml of Perkadox SE-8 (dioctanoyl peroxide), 3 ml of chlorododecane and 0.2 g of sodium laurylsulfate, which emulsion had been homogenized using the same equipment and under the same conditions as stated above for the earlier swelling step. Further, 10 ml of water and 7 ml of acetone were added under agitation at 25°–30° C. After 14 hours the acetone was removed under vacuum. Thereafter 1.2 g of sodium laurylsulfate, 1.0 g Berol 267 and 930 ml of water were added to a total amount of water of 1000 ml. 175 ml of distilled styrene were added under agitation at 25°–30°C. and after 3 hours the temperature was increased to 70° C. to get a complete polymerisation. The final latex was monodisperse and had a particle diameter of about 7 μm.

EXAMPLE 2

This example illustrates the preparation of a black microsuspension. A paste-like carbon dispersion was prepared from butylmethacrylate, the pigment wetting agent Paraloid DM-54 from Rohm & Haas, Philadelphia, USA (an acrylate polymerisate) and Spezialschwarz 4 from Degussa, Frankfurt, F.R. Germany. For the preparation of this dispersion the following were charged:

| | |
|---|---|
| Butyl methacrylate | 251 g |
| Paraloid DM-54 | 157 g |
| Spezialschwarz 4 | 157 g |
| | 565 g |

The mixture was ground on a ground mill equipment until a smooth structure was obtained. The ground dispersion was then diluted with the following:

| | |
|---|---|
| Styrene | 1098 g |
| Butyl methacrylate | 220 g |
| Oleic acid | 47 g |
| Porofor N (Bayer, F.R. Germany) azobisisobutyronitrile | 23 g |
| | 1388 g |

An aqueous solution was prepared from the following:

| | |
|---|---|
| Water | 5830 g |
| Ammonia (2%) | 170 g |
| | 6000 g |

Under slow dosage and under agitation with a high-speed Ultra-Turrax-mixer the carbon-monomer dispersion was charged to the aqueous phase. A fine black emulsion having a droplet size of about 3 μm was formed. This emulsion was then further divided by being pumped twice through a 2-step homogeniser, Gaulin model 15M-8TA, with a pressure drop of 475 kp/cm$^2$. Hereby a fine emulsion with a mean droplet size below 1 μm was obtained. This emulsion was charged to a 14 litre autoclave equipped with an agitator. After evacuation polymerisation was carried out at 72° C. for 8 hours. A black dispersion was obtained.

EXAMPLE 3

Illustrates coating of monodisperse base particles with a black microsuspension.

1.5 kg of monodisperse particles having a diameter of 10 μm, which had been prepared as described in Example 1, were charged to a 8 liter fluid-bed mixer, made by Papenmeyer. The particles consisted of a copolymerisate of 95 percent styrene and 5 percent divinylbenzene. Vacuum was applied to the mixer and the jacket temperature was adjusted to 30° C. The microsuspension from Example 2 was added in portions of 10 ml. About 50 ml/min. were added and the addition of dispesion was stopped after 3.5 litres. The mixer was operated until the mixture became dry. The vacuum pumping was then interrupted and the temperature increased to about 50° C. After cooling a black free-flowing polymerisate was obtained. By microscopic inspection it could be established that the monodisperse base particles had been covered with a uniform layer of particles from the black microsuspension. Only a few of the base particles had agglomerated and these agglomerates could later be separated using an air separator.

The thus obtained carbon pigmented particles are suitable for use as toners. To control the triboelectric charge it can, in certain cases, be suitable to add charge regulating substances at the preparation of the black microsuspension.

EXAMPLE 4

Illustrates the preparation of a polymer solution containing pigment.

The following were charged to a ball-mill of 8 litres:

| | |
|---|---|
| Cyclohexane | 800 g |
| Methylene chloride | 1600 g |
| Methylmethacrylate-butylmethacrylate-copolymerisate 70/30 | 240 g |
| Carbon black, Degussa FWl | 24 g |
| Steel spheres, diameter 5 mm | 5000 g |

The container was rotated for 24 hours and a black polymer solution was then obtained. The solution was filtered throuh a 60 μm strainer screen.

EXAMPLE 5

Illustrates coating of monodisperse base particles with the polymer solution of Example 4.

2000 g of monodisperse particles with a diameter of 10 μm were charged to a fluid-bed mixer. Vacuum was applied. Under fluidised conditions the solution of Example 4 was sprayed onto the mixture. The nozzle was of the 1-phase type and had a capacity of 20 ml/min. at 0.5 MPa. The jacket temperature was 40° C. After that 2.5 litres of solution according to Example 4 had been sprayed on a black powder was obtained. A few monodisperse particles had agglomerated. These could be separated using an air separator. An advantage with this method, compared with that of Example 3, is that the coated particles do not contain residues of emulsifier on the surface.

EXAMPLE 6

Illustrates coating of monodisperse base particles with a black microsuspension containing free carbon black.

Example 3 was repeated but differing in that 2 percent additional carbon black Spezialschwarz 4, based on the dry content of the suspension, had been added to the microsuspension. This mixture was later used for coating of base particles. The particles became somewhat blacker than when no additional carbon black was used. The tendency to agglomerate formation was smaller.

EXAMPLE 7

Illustrates the preparation of an unpigmented latex and the use of this for coating.

The following were charged to an autoclave:

| | |
|---|---|
| Methylmethacrylate | 700 g |
| Butylmethacrylate | 300 g |
| Alkylarylethersulfate | 20 g |
| Ammoniumpersulfate | 8 g |
| Laurylmercaptan | 10 g |
| Water | 3000 g |

After evacuation polymerisation was carried out at 60° C. for 12 hours. A white latex with very small particles (about 0.1 to 0.2 μm) was obtained.

Monodisperse base particles were charged to a fluid-bed mixer. The above prepared latex and a dispersion of magnetite (magnetite in water +1% alkylarylethersulfate) were charged to the mixture as two separate flows. The magnetite dispersion had a dry content of 50 percent. The latex was added twice as rapidly as the magnetite dispersion (35 and 17 ml per minute, respectively). The temperature at the coating was 30° C. The charged was stopped when the added weight of the dry contents of the two dispersion was the same as the weight of the base particles. The batch was then dried under continued mixing. The temperature was increased to 50° C. under agitation and the batch was finally cooled.

Black monodisperse particles with magnetic properties were obtained.

EXAMPLE 8

Unpigmented latex according to Example 7 was charged to a fluid-bed mixer with base particles and a dispersion of Spezialschwarz 4 (10% carbon black, 0.5% alkylarylethersulfate) was charged parallelly. The charge flows were adjusted so that a shell containing 10 percent carbon black was formed around the monodisperse base particles. When the dry content of the charged volume corresponded to 60 percent of the weight of the base particles the additions were stopped. The mixture was dried and then heated under fluidisation to 50° C. Black particles which were free from agglomerates were obtained.

EXAMPLE 9

Example 3 was repeated but after the black microsuspension had been charged to the mixer, the batch was dried and unpigmented latex according to Example 7 was then added in an amount of 1000 g. After drying heat was applied to 50° C. Black monodisperse particles were obtained. As the outer layer of the particles is unpigmented such particles can be advantageous in that the dust which is formed in the copying machines from the abrasion of the particles is less coloured and thus the tendency to greying of the background of copies is reduced.

EXAMPLE 10

At the preparation of polymer solution according to Example 4 the carbon black was replaced by an organic colorant, 20 g oc Ceresschwarz. This solution was then used for coating of monndisperse base particles according to Example 5. Bluish-black particles were obtained.

EXAMPLE 11

Finely divided magnetite was treated with an aqueous solution of Silane A 147 from Union Carbide. The amount of Silane was 1 percent of the amount of magnetite. After drying and curing of the silane coating a polymer dispersion containing 45 percent of this magnetite, based on the dry content of the dispersion, was prepared. The process for the preparation of the dispersion was similar to that described in Example 2 but with the difference that the carbon black was replaced by an amount of magnetite corresponding to 45% of the amount of monomer and magnetite. The styrene was replaced by the same amount of methylmethacrylate. The obtained dispersion was used for coating monodisperse base particles according to the method of Example 3.

EXAMPLE 12

Monodisperse base particles were coated with a microsuspension according to the method of Example 3. However, the monodisperse base particles of 10 μm had been admixed with the same amount weigh of spherical polystyrene grains having a size of 600 μm. A mixture having improved free-flowing properties was obtained in this manner and this facilitated a uniform coating with microsuspension. The microsuspension had been mixed with 10 percent of uncolored latex according to Example 7. The addition of unpigmented latex was made in order to make the small particles of the latex smooth out the surface of the shell and also for contribution to a better adhesion of the polymer particles of the microsuspension to the surface of the monodisperse base particles in connection with the coating.

EXAMPLE 13

Illustrates precipitation of microsuspension around monodisperse base particles.

Monodisperse base particles of 10 μm were dispersed in a 3% solution of sodium oleate. Magnesium chloride was added in an amount twice the stoichiometric amount calculated on the sodium oleate. The excess of the solution was filtered off and the particles were washed with 0.1-% soda lye. After suctioning they were slurried in water and 3% dioctyl adipate were added and then stirring was carried out for 30 minutes at 30° C. Microsuspension according to Example 2 was added dropwise under agitation to the dispersion of treated base particles. After an addition corresponding to 30 percent dry content in the microsuspension, on the weight of the base particles, the addition of microsuspension was stopped. The mixture was stirred for 4 hours at a pH of 10.2. In a microscope it could be seen that the microsuspension had been flocculated around the monodisperse base particles.

1 percent of polyvinyl alcohol, with a degree of hydrolysis of 88, based on the base particle, was added. The pH was lowered to 3.5 by slow addition of hydrochlorid acid and the temperature was increased to 50° C. These operations made the floculated layer around the base particles more dense. After dewatering and washing the particles were dried.

EXAMPLE 14

This example describes the preparation of a latex for preparation of a powder for shell formation. A water soluble initiator was used.

The following were charged to a vessel:

| | |
|---|---|
| 70 | parts of styrene |
| 30 | parts of butylmethacrylate |
| 1.5 | parts of hydrogen peroxide |
| 0.002 | parts of iron, in the form of iron chloride |
| 1 | part of citric acid |
| 4 | parts of lauric acid |
| 0.6 | parts of mercapto ethanol |
| 240 | parts of water |

The pH was adjusted to 8.5 using ammonia. The emulsion was finely divided by means of a high-speed agitator and then charged to a polymerisation reactor. After evacuation the temperature was adjusted to 65° C. After polymerisation for four hours 0.75 parts of hydrogen peroxide were charged additionally. The polymerisation was stopped after 12 hours. A white latex having particles below 1 μm was obtained.

EXAMPLE 15

This example describes the preparation of a black microsuspension. A paste-like carbon dispersion was prepared from butylmethacrylate, the pigment wetting agent paraloid DM-54 fran Rohm & Haas, Philadelphia, USA (an acrylate polymerisate) and Spezialschwarz 4 from Degussa, Frankfurt, F.R. Germany. For the preparation of this dispersion the following were charged:

| | |
|---|---|
| Butyl methacrylate | 251 g |
| Paraloid DM-54 | 157 g |
| Spezialschwarz 4 | 157 g |
| | 565 g |

The mixture was milled on a three roll mill until a smooth structure was obtained. The grated dispersion was then diluted with:

| | |
|---|---|
| Styrene | 1098 g |
| Butylmethacrylate | 220 g |
| Oleic acid | 47 g |

-continued

| | |
|---|---|
| Porofor N (Bayer, F.R. Germany) azobisisobutyronitrile | 23 g |
| | 1388 g |

An aqueous solution was prepared from:

| | |
|---|---|
| Water | 5830 g |
| Ammonia, 2% | 170 g |
| | 6000 g |

With slow dosage and under mixing with a high-speed Ultra-Turrax mixer the carbon-monomer dispersion was added to the aqueous phase. A fine black emulsion with a drop size of about 3 μm was hereby formed. This emulsion was then further divided by being pumped twice throug a 2-step homogenizer, Gaulin Model 15M-8TA with a pressure drop of 475 kp/cm$^2$. A fine emulsion with a means droplet size below 1 μm was hereby obtained. This emulsion was charged to a 14 l autoclave equipped with an agitator. After evacuation polymerisation was carried out at 75° C. for 8 hours. A black dispersion was obtained.

EXAMPLE 16

100 parts of the latex from example 14 was mixed with 3 g of carbon, Spezialschwarz 4 from Degussa, Frankfurt, F.R. Germany. When a paste-like state had been reached the mixture was transferred to a three roll mill and milled twice. The paste spread in a thin layer and allowed to dry in the air. The product was then ground. Using microsopic inspection the powder was found to consist of several black-coloured small particles of less than 1 μm, but also of larger particles of up to 20–30 μm. Both the smaller and larger particles are supposed to be formed from small latex primary particles in admixture with carbon.

The ground powder was for two hours added to a mixer containing the monodisperse base particles mixed with polystyrene particles of 1 mm. The mixture consisted of the following:

| | |
|---|---|
| Base particles | 500 g |
| 1 mm particles | 500 g |
| Powder was added thereto (ground as above) | 500 g |

The temperature at the addition was 55° C. After completed addition of powder for the shell formation the temperature was increased to 60° C. under continued agitation. In this manner a black free-flowing powder was obtained. By microscopic investigation the powder was found to consist of base particles covered with a black shell. The large particles were finally screened off to give the powder.

EXAMPLE 17

100 parts of latex from example 15 was mixed according to example 16 and then used for shell formation.

EXAMPLE 18

Latex according to example 14 was dried at a low temperature without addition of carbon or magnetite powder.

Coated base particles according to example 16 were charged to a mixer. The temperature was adjusted to 55° C. Powder prepared from latex according to example 14 was added for 1 hour. The mixture consisted of the following:

| | |
|---|---|
| Coated base particles | 500 g |
| 1 mm particles | 500 g |
| Powder, from the latex according to example 14 was added thereto | 100 g |

ps The temperature at the addition was 55° C. After completed addition of the powder the temperature was increased to 58° C. A black powder coated with an unpigmented shell was obtained.

EXAMPLE 19

A latex was prepared from the following:

| | |
|---|---|
| Methylmethacrylate | 70 parts |
| Butylmethacrylate | 30 parts |
| Mercapto ethanol | 0.57 parts |
| Lauric acid | 4 parts |
| Methylethylketone hydroperoxide | 0.3 parts |
| Copper, in the form of copper chloride | 0.0002 parts |
| Water | 240 parts |
| Ammonia (to pH 8.5) | 0.22 parts |

Polymerisation was carried out at 60° C. A white latex was obtained. This latex was used for the preparation of a black-pigmented powder according to the method described in example 16 This powder was then used for coating base particles with a shell.

EXAMPLE 20

100 parts of latex from example 14 were mixed with 30 g of finely dispersed magnetite. The viscosity of the mixture was increased gradually. When a paste-like condition had been reached the mixture was spread in a thin layer and dried.

The product was then groud. Microscopy showed that the ground powder consisted of several black-coloured small particles of less than 1 μm but also of larger partcles of up to 20–40 μm. Both the smaller and the larger particles are supposed to be formed small latex primary paticles in admixture with magnetite.

The ground powder was added for two hours to a mixer containing monodisperse base particles mixed with polystyrene particles of 1 mm. The mixture consisted of the following:

| | |
|---|---|
| Base particles | 500 g |
| 1 mm particles | 500 g |
| Powder according to the above was added thereto | 1000 g |

The temperature at the addition was 55° C. After completed addtion of powder for the shell formation the temperature was increased to 65° C. under continued agitation. In this manner a black free-flowing powder was obtained. Microscopy showed that the powder consisted of base particles covered with a black shell. The large particles were finally screened off to yield the powder.

We claim:

1. A proces for the preparation of monodisperse spherical toner particles having a coofficient of variation below 30 percent and a mean diameter between 2 and 50 μm, which includes the steps of (A) providing monodisperse spherical base particles that have been prepared from
  (a) an aqueous dispersion of monodisperse seed particles that in addition to a polymer contain a fairly low molecular weight substance which is difficultly soluble in water but which can be absorbed by the polymer, and
  (b) a monomer which is less difficultly soluble in water than said low moecular weight substance but which can be absorbed in the seed polymer particles containing said fairly low molecular weight substance under conditions permitting molecular diffusion of the monomer to and absorption in the particles, whereafter the monomer in the particles is polymerised, and
(B) forming a shell on each of said base particles, such shell forming comprising the steps of
  (1) adding slowly to the monodisperse spherical base particles a dry polymer powder and a colorant that has been prepared for drying on aqueous dispersion containing finely dispersed polymer particles having a size smaller than one tenth of that of the base particle and a colorant, which drying has been carried out at such a low temperature that the particles do not fuse together,
  (2) agitating the base particles together with said added dry polymer and colorant until a uniform distribution of the dry polymer and the colorant on the base particles is obtained,
  (3) fusing the dry polymer to the base particles by melting the dry polymer powder, and
  (4) repeating at least one of the above steps (1), (2) and (3) until a shell has been formed on the base particles which has a volume between 0.1 and 10 times the volume of the base particles.

2. A process according to claim 1 wherein the polymer powder forming the shell is prepared from an aqueous dispersion of finely dispersed polymer particles, which particles have been prepared by emulsion or suspension polymerization.

3. A process according to claim 2 wherein the finely dispersed polymer particles are prepared by emulsifying and homogenising a solution of the polymer, and removing the solvent.

4. A process according to claim 1 wherein the base particles are kept separated in a continuous gas phase.

5. A process according to claim 4 wherein the polymer is added in powder form to the base particles and that a temperature is provided which is sufficiently high for allowing adhesion of essentially the entire amount of the shell-polymer to the surface of the base particles and at a temperature which is sufficiently low for preventing any substantial agglomeration mutually between the base particles.

6. A process according to claim 5, wherein the temperature is increased after the addition of the shell-polymer for sintering the polymer.

7. A process according to claim 1 wherein a substantial amount of auxiliary particles having a considerably larger size than the base particles, are mixed with the base particles.

8. Toner particles, essentially consisting of monodisperse spherical particles having a coefficient of variation below 30 percent and a mean diameter between 2 and 50 μm, which monodisperse spherical particles comprise a monodisperse spherical base particle core prepared from an aqueous dispersion of monodisperse seed particles having a mean diamter below about 3 μm, and which seed particles in addition to polymer contains a fairly low molecular substance which is difficultly soluble in water but which can be absorbed by the polymer, by addition of a monomer which is less difficultly soluble in water than the difficultly soluble substance but which can be absorbed in the seed polymer particles containing the difficultly soluble substance under conditions permitting molecular diffusion of the monomer to and absorption in the particles and polymerization of the monomer in the particles, and which monodisperse spherical particles further comprise a shell on the base particles prepared by adding slowly, continuously or stepwise, to the polymerized monodisperse spherical base particles, a polymer powder and a colorant, prepared from an aqueous dispersion containing finely dispersed polymer particles, of a size smaller than one tenth of that of the base particle, and colorant, which dispersion has been dried at such a low temperature that the particles do not fuse together, agitating the base particles together with the added polymer and colorant until a uniform distribution of the polymer and the colorant on the base particles is obtained, fusing the polymer to the base particles by melting of the dry polymer powder and repeating one or more of the above steps until a shell has beenformed on the base particles of a volume between 0.1 and 10 times the volume of the base particles.

9. Toner according to claim 8, in which the ratio of shell volume to core volume is between 0.5 and 5.

10. Toner according to claim 8 in which the ratio of shell volume to core volume is between 0.2 and 1.

11. Toner according to claim 8 in which the colorant is a pigment and is present in the shell in an amount between 5 and 40 percent by volume.

12. Toner according to claim 8 in which the particles comprise an uncolored shell on top of the shell containing a colorant.

* * * * *